United States Patent [19]

Schuster et al.

[11] 4,110,962

[45] Sep. 5, 1978

[54] FALSE TWISTING DEVICE

[75] Inventors: Friedrich Schuster; Max Thielemann, both of Hammelburg; Otto Lang, Schweinfurt, all of Fed. Rep. of Germany

[73] Assignee: Kugelfischer Georg Schafer & Co., Schweinfurt, Fed. Rep. of Germany

[21] Appl. No.: 342,085

[22] Filed: Mar. 16, 1973

[30] Foreign Application Priority Data

Mar. 17, 1972 [DE] Fed. Rep. of Germany ..... 2213147

[51] Int. Cl.[2] ..... D02G 1/00; D01H 7/92

[52] U.S. Cl. ..... 57/77.4

[58] Field of Search ..... 57/1 R, 34 R, 77.3–77.45

[56] References Cited

U.S. PATENT DOCUMENTS

| | | | |
|---|---|---|---|
| 2,923,121 | 2/1960 | Tully | 57/77.4 |
| 2,939,269 | 6/1960 | Dobson | 57/77.4 |
| 3,021,663 | 2/1962 | Findlow | 57/77.4 |
| 3,287,890 | 11/1966 | McIntosh et al. | 57/77.4 |

FOREIGN PATENT DOCUMENTS

| | | |
|---|---|---|
| 1,203,072 | 1/1960 | France. |
| 1,222,826 | 4/1960 | Fed. Rep. of Germany. |
| 1,228,751 | 11/1960 | Fed. Rep. of Germany. |
| 405,943 | 3/1065 | Japan. |
| 342,097 | 4/1959 | Japan. |
| 920,658 | 3/1963 | United Kingdom. |
| 854,780 | 11/1960 | United Kingdom. |
| 933,438 | 8/1963 | United Kingdom. |

*Primary Examiner*—Donald Watkins

*Attorney, Agent, or Firm*—Stevens, Davis, Miller & Mosher

[57] ABSTRACT

An apparatus having three spindles carrying overlapping friction discs disposed with their longitudinal axis forming in plan view the corners of an equilateral triangle is provided with a centrally disposed fourth spindle carrying a means for simultaneously and equally adjusting the positions of all three spindles with respect to the track of the thread to be false twisted.

30 Claims, 9 Drawing Figures

FALSE TWISTING DEVICE

The invention relates generally to a device for false twisting or crimping threads by means of friction elements comprising three rotatably symmetrical friction elements supported on spindles which form in plan view the corners of an equilateral triangle, means for simultaneously adjusting the relative position of the spindles while they remain as corners of an equilateral triangle and means for passing a thread along a zig-zag path between the friction elements.

Devices for false twisting threads are known. For example, one such device is disclosed in German Patent DAS No. 1,222,826. In the disclosed arrangement, the three spindles are individually adjustable with respect to each of the other two spindles.

False twisters are also known in which only one of the three spindles is adjustable with respect to the other two (British Patent Specification No. 854,780 and French Patent Specification No. 1,203,072).

The arrangement of the three spindles in such a way that they form in plan view the corners of an equilateral triangle is regarded as the ideal, as in this way the deflection relationships of the thread, with respect to the friction elements are identical. Ideal deflection relationships are given when the deflection angle at associated friction elements is equal and the free paths of the thread between the friction elements are of equal length.

Accordingly, it is the object of this invention to provide a false twister in which despite the adjustability of the spindles ideal deflection relationships of the thread or yarn are maintained. Thereby a greater efficiency and more reliable and economical operation are achieved.

According to this invention, the objects are achieved by providing a false twister of the kind described above wherein all of the spindles are simultaneously and symmetrical adjustable into position with respect to the track along which the thread passes so that the spindles lie at the corners of an equilateral triangle in plan view in all positions of adjustment, with the path of the thread lying at the center of the triangle.

In the false twister provided by the invention ideal deflection relationships are maintained in all positions of mutual adjustment of the spindles. Moreover, there are the following advantages;

(a) As all three spindles can be adjusted simultaneously, the range of adjustment of the device is substantially larger than in one in which only one single spindle is adjusted. This increases the range of application of the device substantially. With a given twister a broader range of differently crimped threads or yarns can be produced.

(b) The threading of the thread or yarn is very simple and because of the symmetrical layout of spindles and of the friction elements on them, the travel of the thread or yarn is very quite and stable, this being essential for high quality crimping.

(c) It is possible to adjust and then lock the positions of the spindles while the twister is in operation and in the shortest possible time so that the tension in the thread or yarn and the degree of false twisting or crimping is identical from one twister to another, a point which is of the utmost importance in achieving good quality.

(d) As the friction elements are arranged symmetrically they can be secured to the drive units which are mutually identical and are therefore interchangeable, a point which reduces manufacturing costs very substantially.

Some embodiments of the invention are described in the following in conjunction with the accompanying drawings in which.

Figure 1:
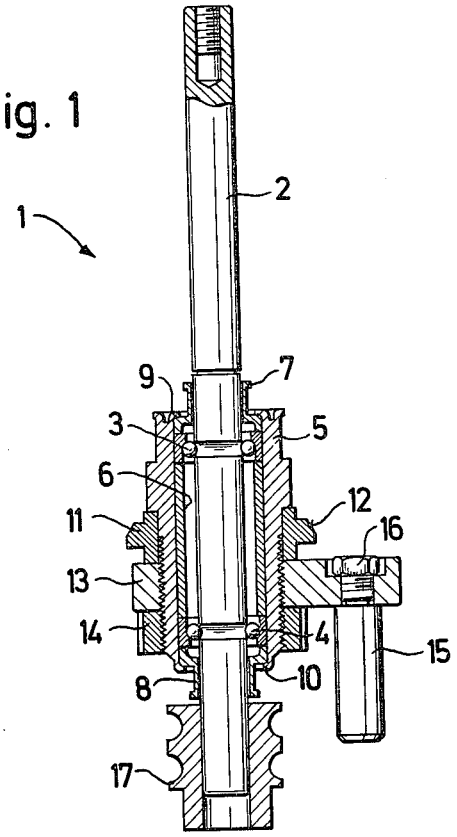
FIG. 1 is a partially axially sectioned side elevation of one embodiment of a drive unit of a false twister provided by the invention.

The preferred complete drive unit 1 illustrated in FIG. 1 comprises a spindle 2 rotatably mounted in a housing 5 in two ball bearings 3 and 4. The ball bearings 3 and 4 are separated by a spacing sleeve 6 and are secured in housing 5 by two outer sleeves 7 and 8 which protect the bearings from penetration by particles of thread. Sleeves 7 and 8 are held by radially inwardly directed beads or flanges 9 and 10 on the ends of the housing 5.

Secured to the outside of the cylindrical housing 5 there is a ring or collar 11 with a conical annular surface 12 and a swinging lever arm 13, held in place by means of a nut 14 screwed onto a screw thread provided on the outside of the housing 5. A pivot pin 15 parallel to the spindle 2 is secured to the lever arm 13 by means of a nut 16. A whorl 17 for driving the spindle 2 is attached to that portion of the spindle 2 which projects from the end of the housing 5 nearest the pivot pin 15.

Figure 2:
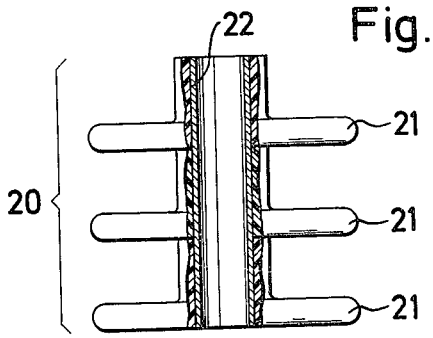
FIG. 2 is a partially axially sectioned side elevation of a set of friction discs designed to fit onto the drive unit of FIG. 1.

The drive unit 1 forms a self-contained unit to which the set 20 of friction discs shown in FIG. 2 may be fitted. The set 20 of discs comprises, in the example illustrated, three friction discs 21 each having a hub and an annular flange at one end of the hub. The discs 21 are secured next to each other on a common central sleeve 22.

Figure 3:
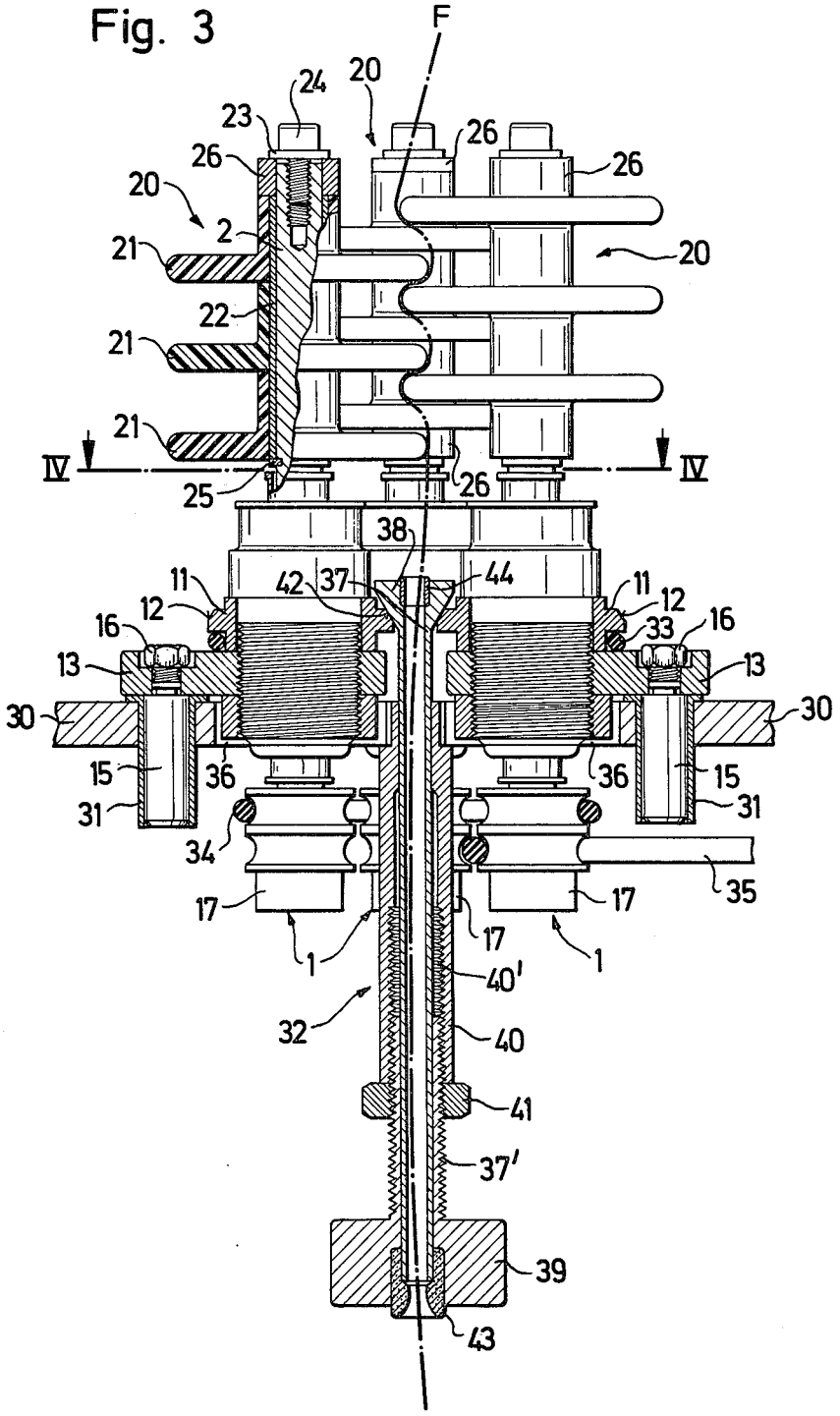
FIG. 3 is a side view, partially sectioned axially along the line III—III in FIG. 4, of a false twister with three of the drive units of FIG. 1, each provided with a set of friction discs in accordance with FIG. 2.

The set of friction discs 20 is fitted on the end of the spindle 2 which is opposite to the whorl 17, with at least one spacing ring 26 interposed, and is held in place against relative rotation by means of a washer 23 and a screw 24, as shown in FIG. 3. That end of the set of discs 20 which is opposite the washer 23 and screw 24 abuts against an abutment ring 25 provided on the spindle 2.

Figure 4:
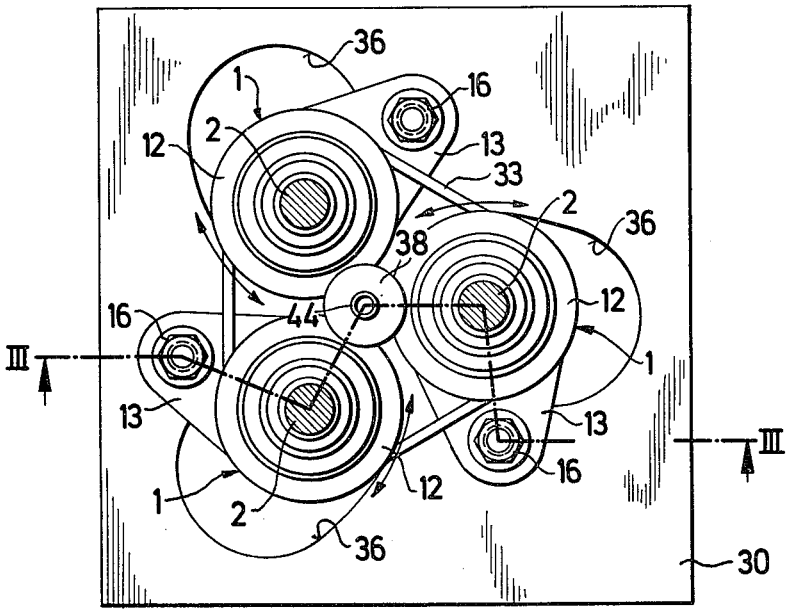
FIG. 4 is a plan view, partially transversely sectioned along the line IV—IV in FIG. 3, of the false twister of FIG. 3.

The false twister illustrated in FIG. 3, which is particularly well adapted for crimping synthetic threads or yarns, is provided with three drive units 1 of the kind shown in FIG. 1, each equipped with a set 20 of friction discs of the kind shown in FIG. 2. The spindles 2 of the three drive units 1 are parallel to each other and in plan view lie at the corners of an equilateral triangle, as shown in FIG. 4. The individual discs 21 of the sets 20 overlap one another, i.e. the discs 21 of each set 20 overlap the discs 21 of both the other sets 20. This is likewise shown in FIG. 3.

The mutually identical sets 20 of friction discs 21 must therefore each be mounted on the spindle 2 of the associated drive unit 1 with the friction discs 21 at different axial positions. This is achieved by the use of the above-mentioned spacer rings 26. In the version illustrated in FIG. 3 such a spacing ring 26 is provided on the spindle 2 of the left hand drive unit 1 above the set 20 of discs, and likewise on the spindle 2 of the right hand unit 1 but in the latter case the discs 20 themselves are inverted, i.e. standing on their heads. On the spindle 2 of the center drive unit 1 there are two spacing rings 26, namely a longer one below and a shorter one above the set 20 of friction discs, the discs being arranged the same way up as those of the left hand unit 1.

The three drive units 1 of the device shown in FIG. 3 are mounted to be movable on a supporting plate 30, each of the pivot pins 15 being inserted in a respective bushing 31 secured to the plate 30. As will be seen in FIG. 4, the relative positions of the nuts 16 which are each co-axial with the associated pivot pins 15 and therefore with the associated bushings 31, are such that the three bushings 31 lie at the corners of an equilateral triangle. The center of the triangle coincides with the center of that equilateral triangle of which the corners are formed by the spindles 2 of the three drive units 1.

Mounted on the supporting plate 30 concentrically with respect to this common center there is a device 32 for the simultaneous mutual adjustment of the drive units 1 radially with respect to the normals to the supporting plate 30 that pass through the common center point. The three drive units 1 are resiliently urged towards each other, i.e. towards the above mentioned common center, by means of an elastic O-ring or loop 33 which passes round the three collars 11 of all three drive units 1.

Spindles 2 are driven by two elastic belts 34 and 35 of round cross-section, such as rubber O-rings. One belt 34 passes around all three whorls 17 of the three units 1. The other belt 35 only passes round one whorl 17 and is driven by a motor (not shown). All three sets 20 of friction discs therefore rotate simultaneously and in the same direction.

The supporting plate 30 is provided with three openings 36, through each of which extends a respective one of the drive units 1 and its associated whorl 17.

In the embodiments shown in FIG. 3, the device 32 for simultaneous mutual adjustment of the drive units 1 comprises a hollow spindle 37 with a conical head 38 on that end which is nearest the units 1 and with a knob 39 at its other end for rotating it.

A guide sleeve 40 is attached to the supporting plate 30 on that face which is away from the discs 20 by a lock nut 41. The spindle 37 is mounted to be rotatable and also axially slidable in the guide sleeve 40. Next to the knob 39, spindle 37 has a portion 37′ of increased diameter provided with an external screw thread. The lock nut 41 screws onto the portion 37′ and in addition this portion 37′ screws into a suitable internal screw thread in a counterbored end portion 40′ of the guide sleeve 40.

The head 38 of the spindle 37 has a conical annular surface 32 which diverges towards the end. The taper on this surface matches that of the conical annular surfaces 12 on the collars 11 of the drive units 1. The elastic loop 33 urges the surfaces 12 into engagement with the surface 42.

Thus, the axial position of the spindle 37 in the sleeve 40 determines the mutual radial spacing of the sets of discs 20. The spindle 37 is locked in the appropriate axial position in the sleeve 40 by tightening the nut 41 against the end of the sleeve 40. The head 38 also holds the three drive units 1 down onto the supporting plate 30, so that the pins 15 cannot jump out of the bushes 31.

When the relative positions of the three sets of discs 20 is to be altered in a radial direction, the nut 41 is first slackened, i.e. it is screwed back on the portion 37′ of the spindle 37 away from the guide sleeve 40. Then the spindle 37 can be axially moved in the sleeve 40 by turning the knob 39. In one direction of rotation of the knob 39 the spindle 37 is screwed further into the sleeve 40, causing all three sets of discs 20 to move simultaneously towards each other. In the other direction of rotation the spindle 37 is screwed further out of the sleeve 40, causing the sets of discs 20 to be simultaneously moved mutually apart. When the desired relative position of the sets of discs 20 is reached the lock nut 41 is tightened up again. In this adjustment all three drive units 1 pivot simultaneously to the same extent, the associated pin 15 turning in the respective bushing 31, i.e. about a longitudinal axis parallel to that of the respective set of discs 20.

An anti-ballooning bushing 43 is mounted in the free end of the knob 39 and a sleeve-like thread guide or bushing 44 is mounted in the free end of the head 38. The bushings 43 and 44 are thus co-axial and are concentric with respect to the common center of the two equilateral triangles of which the corners are formed respectively by the spindles 2 and by the pivot pin 15 of the drive units 1.

The false twister imparts a force twist to a thread F. Thread F may enter, for example, through the bushing 43, coming from a source of supply, (not illustrated), passing through the hollow spindle 37, emerging through the thread guide 44 and following a path between the three sets 20 of friction discs 21, to leave the device through a thread guide (not shown) above the discs 20 and to reach a take-up device, likewise not illustrated. Alternatively, the thread F may pass through the device of FIG. 3 in the opposite direction.

In the region of the three sets 20 of friction discs 21, the thread F follows a zig-zag path with changes of direction at the points of engagement with each of the nine discs 21. The direction-changing relationships of the thread F with the discs 21 are ideal as the discs 21 always form an equilateral triangle and accordingly they stabilize the thread F very accurately.

The mutual adjustment of the sets 20 of friction discs 21 with the aid of the device 32 is done as a rule with the false twister running, i.e. with the thread F passing through and the discs 20 rotating.

The elasticity of belt 34 is of particular importance. It must be elastic enough so that it provides an effective drive for the whorls 17, and therefore for the sets of discs 20 via the spindles 2, in all positions of mutual adjustment of the sets of discs 20.

Figure 5:
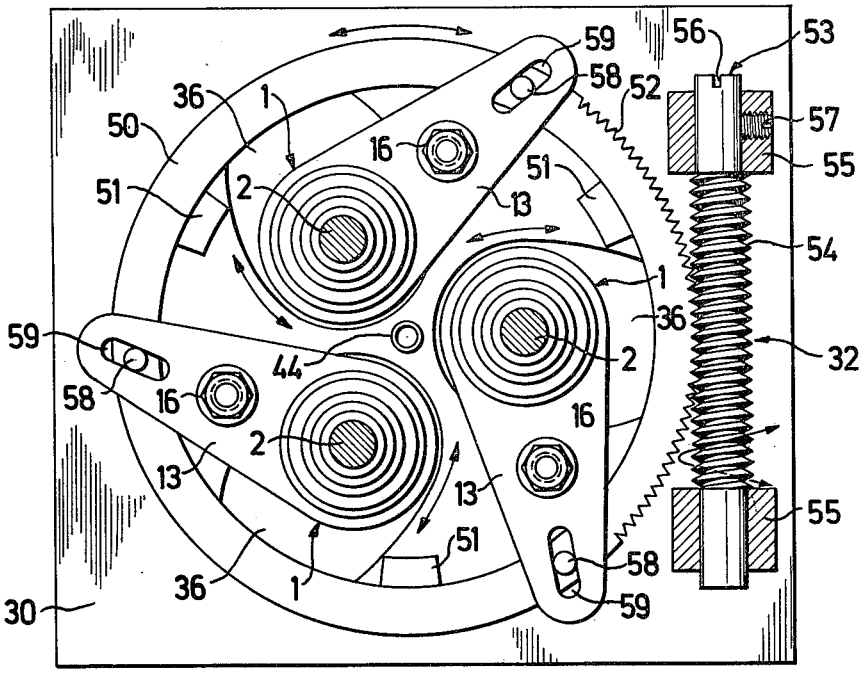
FIG. 5 is a plan view similar to FIG. 4, showing a second embodiment of the false twister.

The embodiment of the device according to the invention shown in FIG. 5 differs from that of FIGS. 3 and 4 solely in the construction of the device 32 for simultaneous mutual adjustment of the radial positions of the drive units 1. Here the device 32 has a ring 50 which is concentric with respect to the common center of the above-mentioned two equilateral triangles, i.e. concentric with the thread guide 44 and is mounted to be rotatable on the supporting plate 30, being guided on projections 51 on that plate. The ring 50 has gear teeth 52 on part of its outer periphery, engaged by a worm 54 on a threaded pin or spindle 53 mounted to be rotatable in two bearing eyes 55 on the plate 30, in a position tangential with respect to the ring 50. The ends of the spindle 53 are provided with screwdriver slots 56 for rotating it. One of the bearing eyes 55 has a grub screw 57 for clamping the spindle 53 in its desired angular position.

The ring 50 has three axially projecting pins 58 spaced uniformly around its periphery, each engaging an elongated hole or slot 59 provided in the free end of a respective one of the swinging lever arms 13, which in this case extend beyond the pivot pins 15 to form two-armed levers.

In the embodiment shown in FIG. 5 the collars 11 can be omitted from the drive units 1. Also, loop 33 is not shown. This can likewise be omitted, and in fact it can also be omitted in the version shown in the embodiment of FIGS. 3 and 4, if the belt 34 is capable of taking over its function.

In the embodiment shown in FIG. 5 the mutual radial spacing of the three drive units 1 and of the spindles 2, is adjusted by turning the spindle 53 after slackening the grub screw 57, causing the ring 50 to rotate on the plate 30. By virtue of the pins 58 the three arms 13 are also moved and are each simultaneously turned to the same angle, with their pivot pins 15 turning in the associated bushings 31, the latter not being visible in FIG. 5 but lying exactly underneath the nuts 16. According to the direction of rotation of the ring 50 the spindles 2 of the three drive units 1 are moved mutually closer together or farther apart. When the desired relative position in a radial direction is reached the worm 54 is clamped in place by tightening the grub screw 57.

Figure 6:
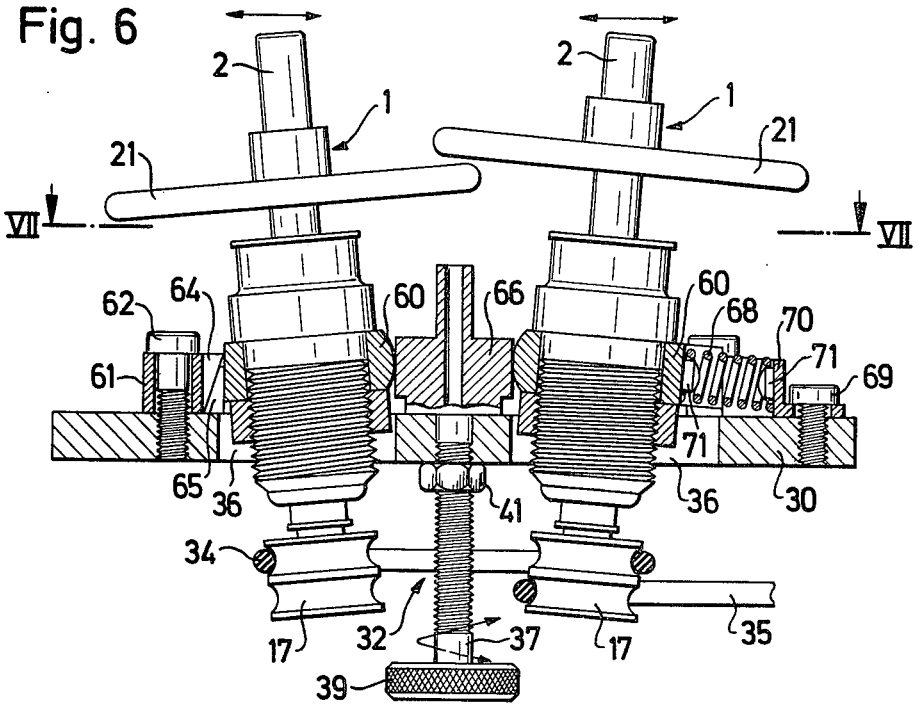
FIG. 6 is a side view, partially sectioned axially along the line VI—VI in FIG. 7 of a third embodiment of the false twister.
Figure 7:
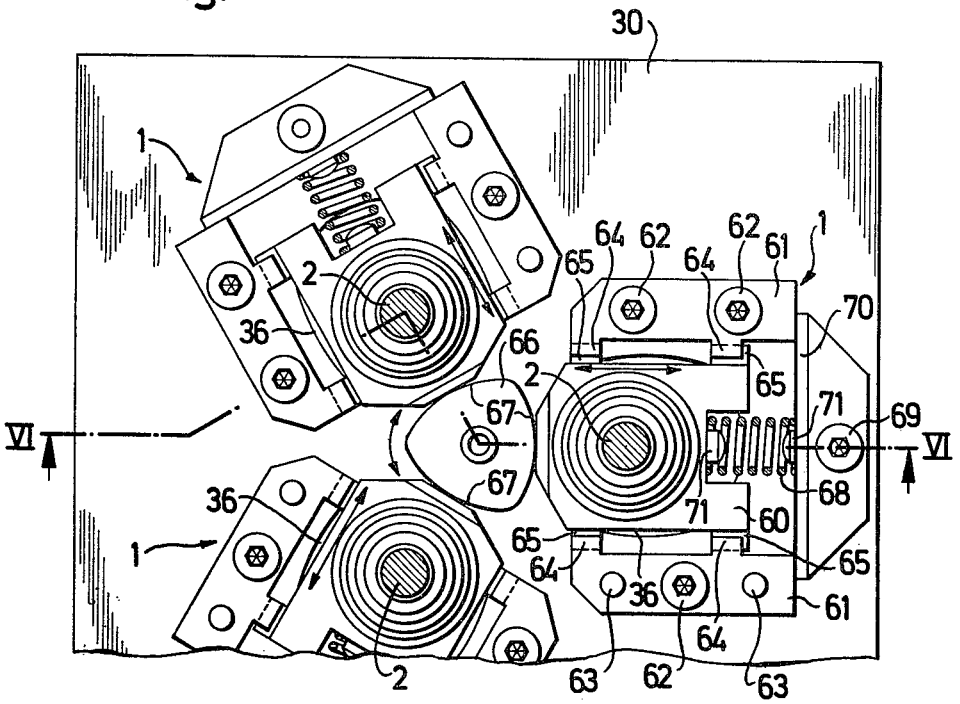
FIG. 7 is a plan view, partially transversely sectioned along the line VII—VII in FIG. 6, of the false twister of FIG. 6.

The embodiment of the device illustrated in FIGS. 6 and 7 differs from those of FIGS. 3, 4 and 5 by a different form of mounting of the movable drive units 1 on the supporting plate 30 and by a different form of the device 32 for simultaneous mutual adjustment of the drive units 1 in a radial direction, and in addition by the fact that each drive unit 1 is provided with only one disc 21.

The spindles 2 of the drive units 1 are inclined with respect to the horizontal supporting plate 30 so that their longitudinal axes each make an acute angle with the path of the thread F to be false twisted (not shown) through the device. Each drive unit 1 is provided, instead of the swinging lever 13, with a sliding shoe 60 which slides between two mutually parallel guide rails 61 on the plate 30. The rails are secured to the plate 30 by screws 62 and dowels 63 and each have two laterally projecting slides 64 which cooperate with complementarily shaped laterally projecting slides 65 on the shoe 60 which is slidable between the two rails 61.

As shown in FIG. 7 there are three pairs of guide rails 61, each embracing an associated shoe 60, the rails and shoes being arranged in a star-like symmetrical pattern around the path of the thread F to be false twisted (not shown). The thread passes through the hollow spindle 37 with its knob 39, the external thread on the spindle 3 carrying the lock nut 41. The spindle 37 extends through a smooth guide bore in the plate 30 and is provided on the end opposite from the knob 39 with a cam 66 in place of the conical head 38. The cam 66 has its periphery formed with three identical lobes 67 each of which is engaged by the free end of one of the shoes 60. The shoe is pressed against cam 66 by a compression spring 68 arranged between the other end of shoe 60 and an angle member 70 secured to plate 30 by a screw 69. The ends of the spring 68 fit over locating pegs 71 on the associated shoe 60 and angle member 70, respectively.

The three drive units 1 illustrated in FIGS. 6 and 7 are thus capable of simultaneous adjustment by equal amounts radially with respect to the path of the thread F (not shown) in such a way that in all mutual positions of adjustment of the three drive units 1, the spindles 2 in all planes parallel to the plate 30 and perpendicular to the path of the thread form the corners of an equilateral triangle, the center of which lies on the path of the thread; the device 32 and in particular the cam 66 being co-axial and concentric with this path.

In order to alter the relative positions in a radial direction of the drive units 1 the lock nut 41 is slackened and then cam 66 is turned by means of the knob 39. When the desired position is reached the nut 41 is tightened again.

Figure 8:
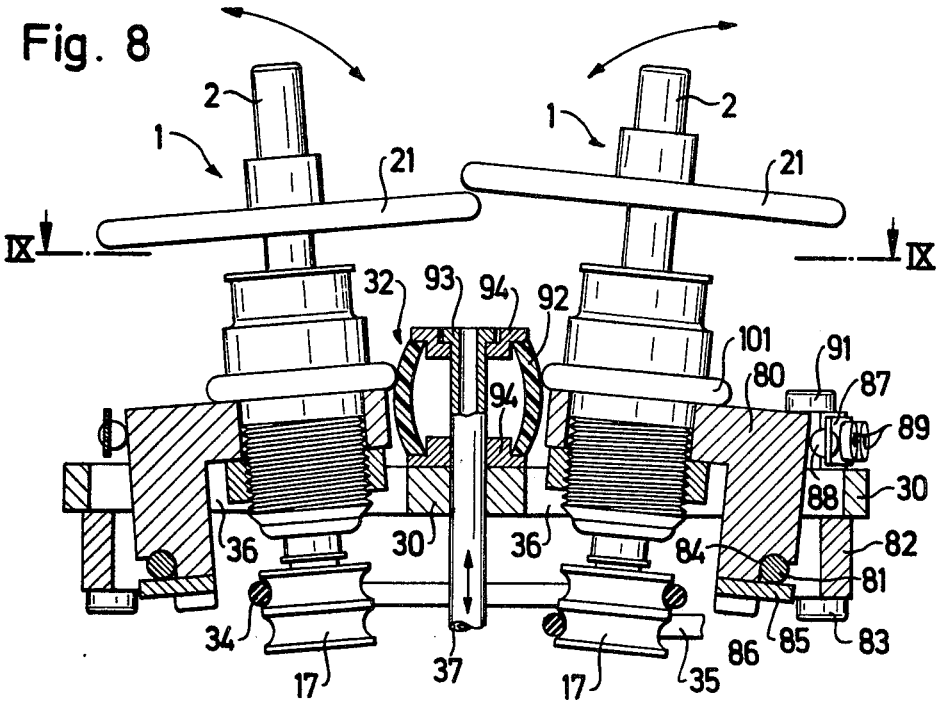
FIG. 8 is a side view, partially longitudinally sectioned along the line VIII—VIII in FIG. 9, of a fourth embodiment of the false twister.
Figure 9:
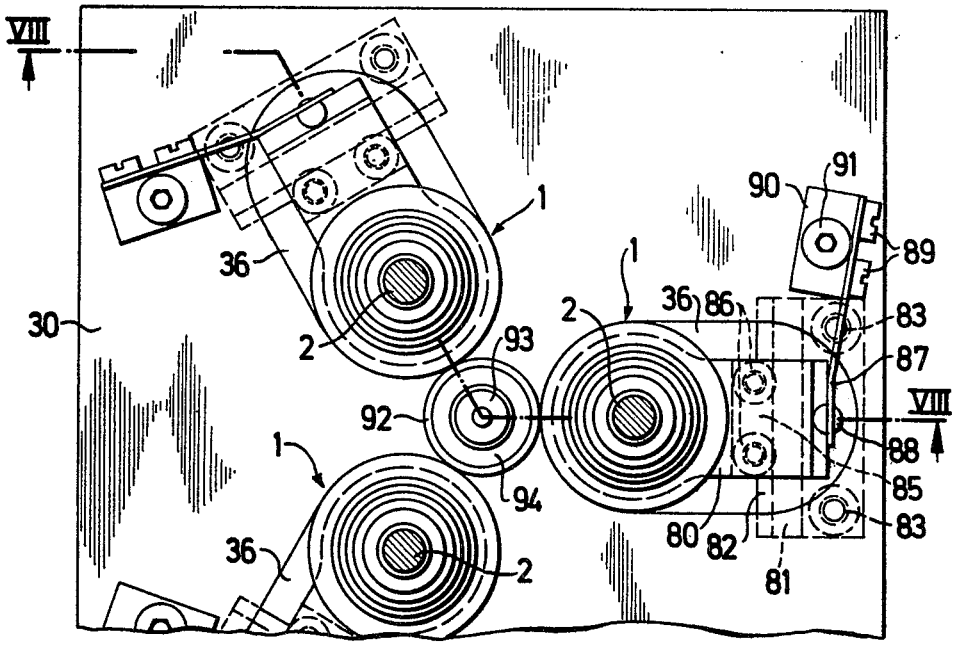
FIG. 9 is a plan view, partially transversely sectioned along the line IX—IX in FIG. 8, of the false twister of FIG. 8.

The embodiment of the device according to the invention shown in FIGS. 8 and 9 differs from that of FIGS. 6 and 7 likewise solely by an alternative arrangement of the drive units 1 on the supporting plate 30 and by a different form of the device 32 for simultaneous relative adjustment of the drive units 1 in radial directions. In contrast to the previous embodiments, the inclination of spindles 2 does not remain constant as units 1 are moved radially on the supporting plate 30. On the contrary, the drive units 1 are pivotally mounted on the plate 30 so that the inclinations of the spindles 2 vary simultaneously to achieve the desired radial adjustment of the friction discs 21 with respect to the path of the thread.

Instead of an arm 13 or a sliding shoe 60, each drive unit 1 is provided with a tilting bracket 80. The bracket 80 is capable of pivoting about a pin 81 extending parallel to the plate 30 and arranged in a U-shaped block 82 attached to the plate 30 by screws 83. The bracket 80 has a notch or recess 84 which embraces the associated pin 81, the notch being perpendicular to the spindle 2 of the associated drive unit 1, and is held on the pin 81 by means of a plate 85 secured to the bracket 80 by means of two screws 86.

As shown in particular by FIG. 9, the three drive units 1 are arranged symmetrically around the device 32 through which the thread F (not shown) passes. With respect to the path of the thread, the three drive units 1 are capable of pivoting simultaneously to the same extent in respective radial planes perpendicular to the plate 30. Each adjacent pair of these planes make together an included angle of 120°. Each pin 81 is perpendicular to the associated plane.

Each bracket 80 is urged towards device 32 by a leaf spring 87, acting through a ball 88. The spring 87 attached by screws 89 to a block 90 which in its turn is secured by a screw 91 to the plate 30.

The device 32 of FIGS. 8 and 9 has on the hollow spindle 37, in place of the head 38 or the cam 66, a radially deformable head which comprises a ring 92 of resilient material, for example, rubber or a resilient plastics material, clamped on the spindle 37 between two annular discs 94. The one disc engages a collar 93 on the end of the hollow spindle 37 and the other engages the plate 30. The spindle 37 is secured in the axial position shown with respect to the supporting plate 30 in a manner not illustrated.

To adjust the drive units 1 the spindle 37 is axially displaced with respect to the supporting plate 30 after its clamping has first been released. This causes the outside diameter of the ring 92 to increase or decrease according to the direction of displacement, and accordingly it causes the three drive units 1, which each have an annular flange or collar 101 on the ring 11 bearing against the ring 92, to swing apart or together. When the desired setting has been reached the spindle 37 is clamped again.

The combinations illustrated in the drawings and described above for the various forms of the device 32 on the one hand and the movable arrangement of the drive units 1 on the carrier plate 30, on the other hand, could also be arranged in other ways. For example, the device 32 in the embodiment of FIGS. 3 and 4 could also be employed with the drive units 1 arranged in the ways shown in FIGS. 6 and 7 or 8 and 9, if necessary with the conical surface 42 arranged inverted or differently. Likewise, the device 32 of FIGS. 6 and 7 could be used with the drive units 1 mounted on the supporting plate 30 in the way according to FIGS. 3 and 4 of FIGS. 8 and 9. Finally, it is possible to make use of the device 32 of FIGS. 8 and 9 in the drive-unit arrangement of FIGS. 3 and 4 or FIGS. 6 and 7. However, the combination shown in the drawings are preferred.

The drive units 1 can be interchanged or replaced as required, either independently of the friction discs sets 20 or discs 21 or complete with those sets or discs. In each case the rubber belt 34 and, if necessary, the belt 35 is removed from the whorls 17. Then in the embodiment shown in FIGS. 3 and 4 the head 38 is displaced towards the sets 20 of friction discs. The drive units 1 can then be lifted out, with their pins 15 coming clear of the bushings 31.

In the embodiment shown in FIGS. 6 and 7 each drive unit 1 can be removed by detaching the associated spring 68 and then sliding the associated shoe 60 back towards the adjacent angle member 70 so that the slides 64 and 65 come out of mutual engagement. The unit then can be taken out, complete with the shoe 60 attached to it.

In the embodiment shown in FIGS. 8 and 9 removal of a drive unit 1 only requires the plate 85 to be detached from the associated tilting bracket 80 by undoing the screw 86.

In each of the false twisters described therefore, three drive units 1, each with a friction disc 21 (or a set of friction discs 20 made up of a number of discs 21) on a spindle 2 are mutually adjustable simultaneously to an equal extent so that in all positions of the drive units 1 the spindles 2 form an equilateral triangle in all planes perpendicular to the common central axis, the center of the triangle lying on this axis, along which the thread to be false twisted passes through the device. This permits extremely accurate and sensitive adjustment of the discs 21 or sets of discs 20 in accordance with the nature and the size of the thread to be false twisted at any given time. The direction-changing relationships of the thread with respect to the friction discs 21 are improved and the free path between the discs 21 is shortened. The range of use of the false twister is substantially increased because threads or yarns of different dimensions and natures can be false twisted using this device. The false twister provided by the invention is particularly advantageous for crimping synthetic fibers efficiently and economically.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. In an apparatus adapted for crimping synthetic threads or the like having three rotatably mounted adjustable spindles each provided with at least one rotationally symmetrical friction element, said spindles lying at the corners of an equilateral triangle in plan view and means for passing a thread which is to be false twisted between the friction elements in a zig-zag path, means for simultaneously adjusting all of said spindles with respect to the path of the thread with the spindles remaining at the corners of an equilateral triangle in plan view in all positions of adjustment with the center of the triangle lying on the path of the thread, comprising means co-axial with respect to the path of the thread, for simultaneous adjustment of the spindles, characterized in that means are provided for resiliently urging the spindles towards said co-axial means.

2. The apparatus of claim 1 characterized in that the said co-axial means comprises a hollow axially movable spindle having a head which projects between the spindles and has a conical annular surface against which each spindle is urged by means of its associated housing.

3. The apparatus of claim 2 wherein each housing has a conical annular surface which has an inclined surface complementary to the conical annular surface of said head.

4. The apparatus of claim 2 having a supporting plate for the spindles and wherein the conical annular surface of the head diverges in a direction away from said plate.

5. Device according to claim 1 characterised in that the device (32) comprises a hollow axially movable spindle (37) with a head (92, 94) of variable outside diameter which projects between the spindles (2) which are each provided with an associated housing (5) urged against the head (92, 94).

6. Device according to claim 5 characterized in that an annular bead (101) is provided on each housing (5) for engaging the head (92, 94).

7. Device according to claim 5 characterized in that the head comprises a ring (92) of resilient material and two annular discs (94) engaging the ring (92) between their faces, the discs being guided on the spindle (37) and engaging a collar (93) on the spindle (37) at the end nearest the ring (92) and a supporting plate (30) for the spindles (2).

8. Device according to claim 1 characterised in that the spindle (37) is screwed into a guide sleeve (40) provided in or on the supporting plate (30) for the spindles (2).

9. Device according to claim 1 characterized in that the device (32) comprises a hollow rotatable spindle (37) with an eccentric (66) projecting between the spindles (2) and having three shaped portions (67) against each of which the housing (5) of a respective spindle (2) is urged.

10. Device according to claim 1 characterised in that the spindles (2), which are arranged parallel to each other and to the path of the thread, are each pivotable about an axis (15, 31) parallel to the longitudinal axis of the spindle.

11. Device according to claim 10 characterised in that the axes (15, 31) about which the spindles can pivot form in plan view the corners of an equilateral triangle, of which the centre lies on the path of the thread.

12. Device according to claim 10 characterised in that a swinging lever (13) is provided on the housing (5) of each spindle (2) and has a pivot pin (15) parallel to the spindle (2) and rotatably received in a bush (31) on a or the supporting plate (30) for the spindles (2).

13. Device according to claim 1 characterised in that the spindles (2) are each arranged inclined and making an acute angle with the path of the thread.

14. Device according to claim 1 characterised in that a sliding shoe (60) is provided on the housing (5) of each spindle (2), the shoe being guided between two lateral parallel guide rails (61).

15. Device according to claim 14 characterised in that each sliding shoe (60) is provided on both sides with two mutually spaced projecting slides (65) and the two associated guide rails (61) each have two complementary laterally projecting slides (64) co-operating with them.

16. Device according to claim 1 characterised in that the spindles (2) are each capable of pivoting in a plane radial with respect to the path of the thread.

17. Device according to claim 16 characterised in that a tilting bracket (80) is provided on the housing (5) of each spindle (20) and is capable of pivoting about a pin (81) perpendicular to the associated radial plane.

18. Device according to claim 1 characterised by an elastic O-ring (33) passing round the housings to urge the spindles (2) together.

19. Device according to claim 1 characterised by a number of springs (68, 87) urging the spindles (2) together, each being associated with a respective spindle (2) and engaging its housing (5) or its shoe (60) or its tilting bracket (80).

20. Device according to claim 1 characterised by a device (32) co-axial with respect to the path of the thread for simultaneous adjustment of the spindles (2), comprising a rotatable ring (50) surrounding the spindles (2) and engaging them or their housings (5).

21. Device according to claim 20 characterised in that the ring (50) is provided over a part of its outside periphery with gear teeth (52) engaged by an external screw thread (54) on a worm (53) mounted to rotate about an axis tangential to the ring (50).

22. Device according to claim 20 characterised in that the ring (50) is rotably mounted on a or the supporting plate (30) for the spindles (2), being guided on lugs (51) on the plate.

23. Device according to claim 13 characterised in that each swinging lever (13) is of two-armed construction and has on that arm which is remote from the associated spindle (2) an elongated hole (59) engaged by an axially projecting peg (58) on the ring (50).

24. Device according to claim 1 characterised in that the device (32) for simultaneously adjusting the spindles (2) is capable of being clamped.

25. Device according to claim 1 in which each spindle is provided with a whorl, of which one is connected to a driving motor and it takes the other two whorls with it, characterised by an elastic O-ring (34) passing round all three whorls (17).

26. Device according to claim 25 characterised in that each spindle (2) with the associated housing (5), the bearings (3, 4, 6) in it, the associated whorl (17) and the swinging lever (13) or sliding shoe (60) or tilting bracket (80) forms a self-contained interchangeable unit.

27. In an apparatus adapted for crimping synthetic threads or the like comprising three spindles lying at the corners of an equilateral triangle in plan view, each of said spindles being provided with at least one rotationally symmetrical friction disc rotatable therewith and overlapping in longitudinally spaced relationship the friction discs of the other two spindles, and means for passing a thread which is to be false twisted between the friction discs in a zig-zag path, means for rotating each spindle comprising a whorl longitudinally spaced from its disc and fixed thereto, a housing about each spindle intermediate the whorl and disc, an annular ring about the housing having an exposed sloping surface, means comprising a plate having three openings therein each adapted to support a spindle with its longitudinal axis generally perpendicular thereto, means carried by the housing for pivotally securing each spindle in its opening, resilient means about the three spindles urging them towards each other, and means opposing the force of said resilient means comprising a fourth spindle disposed in equally spaced relationship from the said three spindles and extending substantially parallel thereto, a frusto-conically shaped head carried by the fourth spindle on one end thereof and having its frusto-conically shaped surface lying against each of the sloping surfaces of the said annular rings, and means for moving the fourth spindle and its head longitudinally with respect to the annular ring and thereby move the said housings and three spindles radially simultaneously comprising a guide sleeve about the fourth spindle fixed against longitudinal movement with respect to the plate, and a screw fixed to the spindle and threadably mounted in the guide sleeve.

28. In an apparatus adapted for crimping synthetic threads or the like comprising three spindles lying at the corners of an equilateral triangle in plan view, each of said spindles being provided with at least one friction disc rotatable therewith and meshing in longitudinally spaced relationship with the friction discs of the other two spindles, means for rotating each spindle comprising a whorl longitudinally spaced from its disc and fixed thereto, means equally spaced from all three spindles for introducing a thread between the said discs, means for supporting the spindles comprising a plate having three openings each adapted to receive a spindle, a lever arm secured to the spindle and pivotally securing the spindle to the plate, a slot in each lever arm adjacent to that end spaced from the spindle, a ring about all three spindles having an upstanding pin in each slot, gear teeth for rotating the ring and moving the pins in the slots to thereby simultaneously pivot the spindles equally towards and from the means for introducing thread.

29. In an apparatus adapted for crimping synthetic threads or the like comprising three rotatably mounted spindles lying at the corners of an equilateral triangle in plan view, each of said spindles being provided with at least one friction disc rotatable therewith and meshing in longitudinally spaced relationship with the frinction discs of the other two spindles, means for passing a thread which is to be false twisted between the friction discs, means for rotating each spindle comprising a whorl longitudinally spaced from its disc and fixed thereto, means comprising a plate having three openings therein each adapted to support a spindle with its longitudinal axis generally perpendicular thereto, a fourth spindle extending through the plate and spaced equally from all three of the first said spindles, a cam secured to the spindle having three identical sides, a sliding shoe secured to each spindle and resilient means for urging the shoe against a surface of the cam, and means for rotating the fourth spindle and moving the cam thereby moving the first said spindles towards and from each other.

30. In an apparatus adapted for crimping synthetic threads or the like comprising three rotatably mounted spindles lying at the corners of an equilateral triangle in plan view, each of said spindles being provided with at least one friction disc rotatable therewith and meshing in longitudinally spaced relationship with the friction discs of the other two spindles, means for passing a thread which is to be false twisted between the friction discs, means for rotating each spindle comprising a whorl longitudinally spaced from its disc and fixed thereto, a supporting plate having three openings therein each adapted to receive a spindle and means for pivoting the spindle in the opening comprising an annular flange on each spindle and a fourth spindle substantially parallel to the first said spindles and spaced equally from all three, a barrel shaped member carried by the fourth spindle and disposed with its peripheral surface against said annular flange of each spindle, and means for moving the said member longitudinally with respect to the annular flange.

* * * * *